US007778424B2

(12) United States Patent
Lange

(10) Patent No.: US 7,778,424 B2
(45) Date of Patent: Aug. 17, 2010

(54) METHOD AND A DEVICE FOR REAL EAR MEASUREMENTS

(75) Inventor: Henrik Lange, Valby (DK)

(73) Assignee: Widex A/S, Lynge (DK)

( * ) Notice: Subject to any disclaimer, the term of this patent is extended or adjusted under 35 U.S.C. 154(b) by 1007 days.

(21) Appl. No.: 11/520,810

(22) Filed: Sep. 14, 2006

(65) Prior Publication Data

US 2007/0009107 A1 Jan. 11, 2007

Related U.S. Application Data

(63) Continuation-in-part of application No. PCT/DK2004/000182, filed on Mar. 18, 2004.

(51) Int. Cl.
*H04R 25/00* (2006.01)

(52) U.S. Cl. ..... 381/60; 381/328; 381/382

(58) Field of Classification Search ..... 381/60, 381/322, 328, 380–382
See application file for complete search history.

(56) References Cited

U.S. PATENT DOCUMENTS 4,827,525 A 5/1989 Rising et al.
5,022,486 A * 6/1991 Miura et al. ..... 381/382
5,645,074 A 7/1997 Shennib
6,009,183 A * 12/1999 Taenzer et al. ..... 381/382
6,154,546 A 11/2000 Uvacek
6,560,346 B2 * 5/2003 Ohta et al. ..... 381/382

* cited by examiner

*Primary Examiner*—Suhan Ni
(74) *Attorney, Agent, or Firm*—Sughrue Mion, PLLC

(57) ABSTRACT

An adapter for coupling a probe tube (6) for real ear measurements to a microphone of a hearing aid comprises a sleeve (2) adapted to be arranged around the housing (8) of a hearing aid. The sleeve comprises a sound opening allowing sound to pass from the probe tube to the microphone. The device may be used in a method for performing real ear measurements comprising the steps of providing the device, fitting the device around the housing of the hearing aid with the sound opening is placed over the microphone of the hearing aid, placing the probe tube in the ear in such a way that a free end thereof presents an opening in the cavity between the earplug and the tympanic membrane, and detecting the sound pressure from sounds produced by said hearing aid in the cavity using the microphone.

16 Claims, 7 Drawing Sheets

METHOD AND A DEVICE FOR REAL EAR MEASUREMENTS

RELATED APPLICATIONS

The present application is a continuation-in-part of application No. PCT/DK2004/000182, filed on Mar. 18, 2004, in Denmark and published as WO 2005/089016 A1.

BACKGROUND OF THE INVENTION

1. Field of the Invention

The present invention relates to hearing aids. The invention more specifically relates to an adapter for coupling a probe tube to a microphone of a hearing aid. The invention, still more specifically, relates to a device comprising such an adapter. The invention also relates to a method for real ear measurements.

Real ear measurements are of great advantage when fitting hearing aids to the individual user. Though the general characteristics of a hearing aid are normally known from measurements with a model ear, known as a coupler, these may not fully reflect the actual characteristics when the hearing aid is placed in a real ear, as there may be significant individual variations in the ear canals. This is in particular the case with children, but also with people who have a damaged or deformed ear canal, e.g. due to surgery.

Also, when fitting a hearing aid for children, the real ear measurement of the actual sound pressure level in the ear is of interest. This is because the replies from children as to comfort and sound perception are less reliable than those from adults. Thus, a difference between the actual characteristics of the hearing aid, when placed in the ear, and those measured with a coupler might go undetected. This again could lead to incorrect fitting, e.g. a fitting with too much gain, likely to cause uncomfortably loud sound levels, or too little gain, likely to cause too soft levels of sounds that do not compensate the users hearing deficiency.

2. The Prior Art

For performing such measurements, it has been suggested to make use of a hearing aid. U.S. Pat. No. 6,154,546 suggests connecting a sound conducting tube, referred to as a probe tube, from the cavity between the earplug and the tympanic membrane to one or more of the external input microphones of a hearing aid. It is stated that the probe tube may be connected to the external microphone via an adapter. However, the adapter is only illustrated schematically and not described in any detail, other than a schematic suggestion of a short length of rigid pipe. How this adapter itself would be connected to the housing or the microphone is also not described.

It is the object of the present invention to provide an adapter for coupling a probe tube to a microphone of a hearing aid.

It is a further object of the present invention to provide a device for real ear measurements incorporating an adapter for coupling a probe tube to a microphone of a hearing aid.

It is still a further object to provide a method for performing real ear measurements.

SUMMARY OF THE INVENTION

According to a first aspect of the invention, this first object is achieved by an adapter for coupling a probe tube for real ear measurements to a micro-phone of a hearing aid, comprising a sleeve adapted to be arranged around the housing of a hearing aid, said sleeve comprising a sound opening allowing sound to pass from the probe tube to the microphone.

Such a sleeve not only allows precise alignment between the microphone of the hearing aid and the probe tube, but also prevents the probe tube from becoming detached from the hearing aid during the measurements.

According to a first embodiment, the sleeve comprises a tubular member arranged in connection with said sound opening and adapted for engaging the inner wall of said probe tube. Using such a tube is advantageous as the tube may easily be secured to the sleeve by embedding it in the mould, when manufacturing the sleeve. Moreover the use of a tube allows for easy fitting and removal of the probe tube.

It is particularly advantageous if the tubular member is a metal tube. Because of the rigidity, a metal tube facilitates the fitting and removal of the probe tube.

According to another aspect of the invention, the sleeve is made of a resilient material. Having a sleeve of a resilient material allows the use of one and the same adapter according to the invention together with different hearing aid constructions, e.g. with different housings.

According to a particularly preferred embodiment, the sleeve is at least partially made of transparent material. Using a transparent material for at least a part of the sleeve facilitates the positioning of the adapter on the hearing aid housing, because it allows visual inspection of the match between the microphone opening in the hearing aid housing and the sound opening in the sleeve.

According to specific embodiment, the sleeve is made of silicone rubber. The use of silicone rubber is advantageous. It allows all the above, preferred embodiments to be implemented in one single adapter according to the invention.

According to a further embodiment, the adapter comprises a sleeve positioning means. The use of a sleeve positioning means allows for even better positioning of the adapter with respect to the microphone opening, than simple visual inspection through a transparent sleeve.

According to a specific embodiment, the sleeve comprises a visual sleeve positioning means. The use of a visual sleeve positioning means in conjunction with the transparency of the sleeve facilitates the positioning of the adapter by the visual inspection through the transparent sleeve.

According to a preferred embodiment, the sleeve positioning means comprises a groove. A groove is advantageous in that it may serve both as an engaging means for a hearing aid housing provided with corresponding engagement means such as protrusions or the like or as a visual positioning line if the hearing aid does not have such engagement means.

According to a second aspect of the invention, the object is achieved by a device for real ear measurements, comprising a probe tube and an adapter for connecting the probe tube to a microphone of a hearing aid, said adapter hav-ing a sleeve adapted to be placed around the housing of the hearing aid, and said sleeve providing a sound opening allowing sound to pass from the probe tube to the microphone.

According to a preferred embodiment, the sleeve and the probe tube constitute an integral unit. This may from a manufacturing view be advantageous.

According to another preferred embodiment, the probe tube comprises tube positioning means for correct positioning in the ear. Such a tube positioning means is advantageous in that it aids in ensuring the correct positioning of the free end of the probe tube in the cavity between the ear plug of the hearing aid and the tympanic membrane, e.g. in order to ensure that it does not touch the latter and thereby cause discomfort to the user.

Preferably, the tube positioning means comprises a collar slidable along the probe tube. This allows the tube positioning means to be placed at a given distance from the end of the probe tube, where said distance e.g. corresponds to a predetermined distance from the desired measuring position of the tube in the cavity between the ear plug and the tympanic membrane along said ear plug to the outer surface thereof. Thus, by visually aligning the tube positioning means of said probe tube with the outer surface of the hearing aid plug, the correct positioning of the probe tube, in particular the free end thereof, in the ear is ensured.

According to a third aspect of the invention, there is provided a method for performing real ear measurements using a microphone of a hearing aid, comprising the steps of providing a probe tube; providing an adapter for connecting the probe tube to the microphone, said adapter having a sleeve adapted to be placed around the housing of the hearing aid, and said sleeve providing a sound opening allowing sound to pass from the probe tube to the microphone; fitting said adapter around the housing of the hearing aid so that the sound open-ing is placed over the microphone; placing the probe tube in the ear in such a way that a free end thereof presents an opening in the cavity between the earplug and the tympanic membrane; and detecting the sound pressure from sounds produced by said hearing aid in said cavity using said microphone.

Thereby precise real ear measurements may be performed with a well-defined coupling between the microphone of the hearing aid and the cavity in the ear via the probe tube, without the risk of the probe tube becoming detached from the hearing aid.

According to a preferred embodiment, the step of detecting the sound pressure is preceded by a calibration step, in which the free end of the probe tube is placed in close conjunction with the output transducer of the hearing aid, and in which the sound pressure is measured based on predetermined acoustic output signals generated by the hearing aid.

Thereby good control over the response of the hearing aid and adjustment of the frequency response may be achieved.

BRIEF DESCRIPTION OF THE DRAWINGS

For a better understanding of the invention, a detailed description based on non-limiting exemplary embodiments will now be given with reference to the accompanying schematic drawings, on which

DETAILED DESCRIPTION OF THE INVENTION

Figure 1:
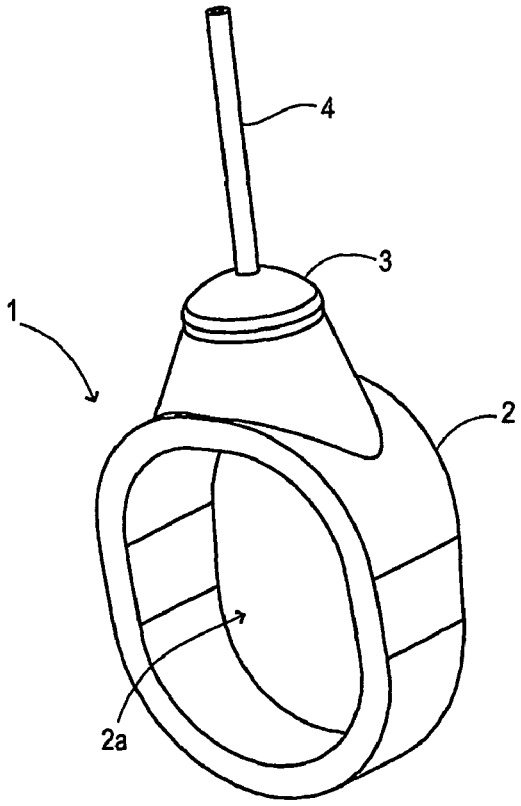
FIG. 1 is a perspective view of an adapter according to the invention.
Figure 2:
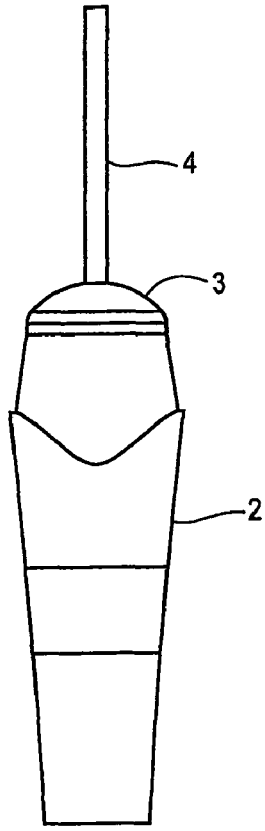
FIG. 2 is a side view of the adapter of FIG. 1.
Figure 3:
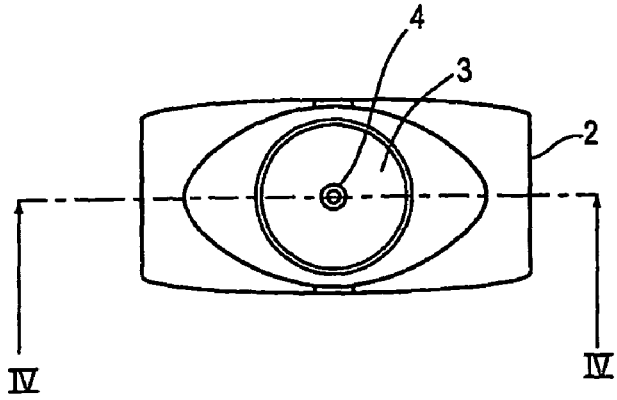
FIG. 3 is a top plan view of the adapter of FIG. 1.

Reference is first made to FIG. 1. FIG. 1 shows a perspective view of a preferred embodiment of an adapter 1 according to the invention. The adapter 1 comprises an assembly of three parts, viz. a sleeve 2, an insert part 3, and a connection part 4 for connecting the adapter to a probe tube 6 (ref. FIGS. 5-9). The sleeve 2 is preferably oval and defines a central aperture 2*a* in which a hearing aid is to be placed, as best seen in FIGS. 5-8.

Other embodiments with fewer or more parts may of cause be implemented; in particular the insert part 3 may be omitted, depending on the choice of materials. Also, according to one embodiment, the insert and the metal tube may be manufactured integrally from one piece of metal, by appropriate machining, e.g. by turning on a lathe.

Figure 4:
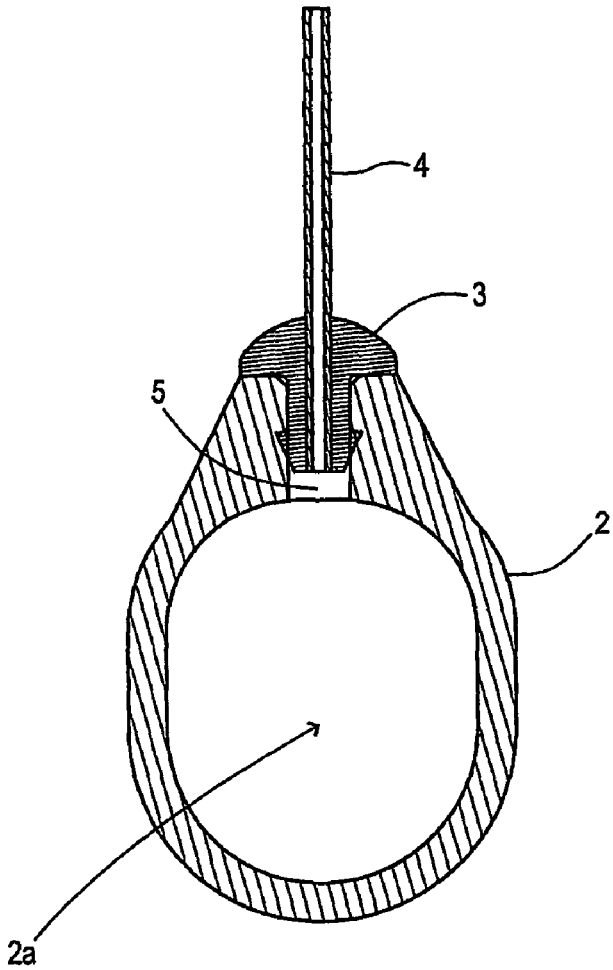
FIG. 4 is a cross sectional view of the adapter of FIG. 1 taken along the line IV-IV in FIG. 3.

In the preferred three part embodiment, however, the oval sleeve 2 is made of an elastic, resilient material such as silicone rubber, the insert 3 is made of a rigid plastic material, and the tube 4 is a metal tube, e.g. of surgical steel of the kind used for syringes. The metal tube 4 is generally arranged perpendicularly to the aperture 2*a* in the sleeve 2, as it is best seen in FIG. 4. It should be noted that depending on the elastic properties of the material of the sleeve 2 and/or the shape of the hearing aid with which it is intended to be used, the shape of the sleeve 2 could differ from the oval shape mentioned above. In particular, the central aperture 2*a* could be circular.

The sleeve 2 is adapted for being slid over the hearing aid housing 8 to be left in a suitable position where it will be retained by friction between the sleeve and the housing by resilient tension in the sleeve 2.

The adapter may be manufactured by molding the plastic material of the insert 3 around the metal tube 4 at one end thereof, leaving a free length of metal tube 4 projecting from the insert 3, and leaving a free passage through the metal tube 4, and then molding the elastic sleeve 2 with an appropriate cavity in the form of a through hole 5 for the insert. After the two parts have been formed, be it by molding in one or two pieces or machining as described above, the insert 3 is inserted into the through hole, where it may be held solely by the friction and elastic forces between the elastic sleeve 1 and the insert 3. If desired, it may of course be additionally secured by means of glue or the like.

Figure 9:
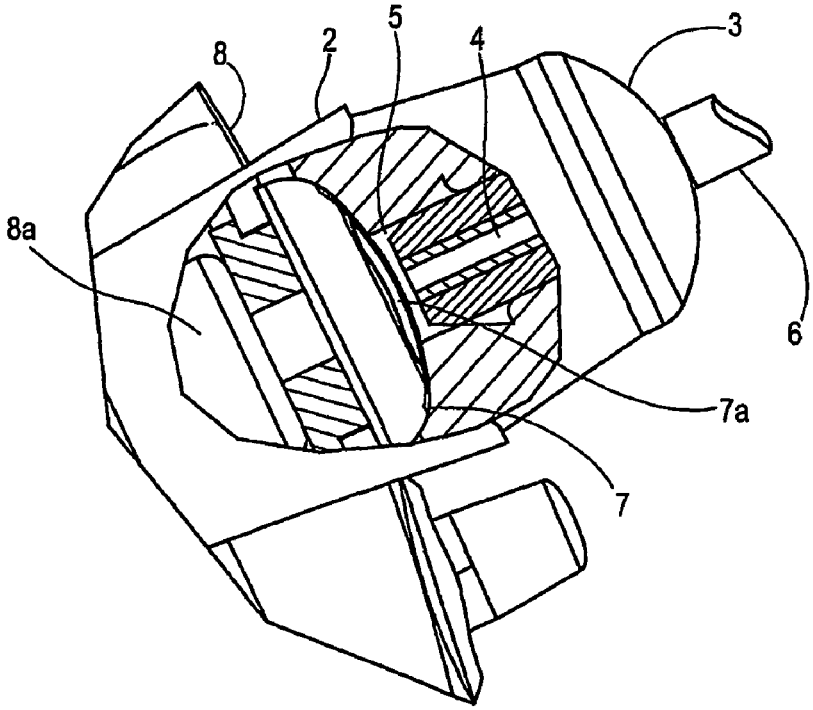
FIG. 9 is a detail of the partially cut away side view of FIG. 8.

As best seen in FIG. 9, the through hole 5 furthermore serves as a communication passage for the sound from the probe tube 6 to the microphone 8*a*. In FIG. 9 the microphone 8*a* is placed under a dome-shaped protrusion 7 having a microphone port 7*a*, but the microphone 8*a* might just as well lie in close connection with a microphone port in the form of a hole (not shown) in the housing 8 of a hearing aid.

In cases where the microphone 8*a* is placed under a protrusion, the through hole 5 may aid in the correct positioning of the adapter with respect to the microphone 8*a* because of the elastic properties of the sleeve in combination with the shape of the edge of the through hole 5.

Preferably the sleeve 2 is made of a transparent material such as the silicone rubber already mentioned. Also, the insert 3 may be made of transparent material. The transparency of one or both of these materials allows the position of the through hole 5 with respect to the microphone 8*a* or the microphone port 7*a* to be visually inspected through the adapter, so as to facilitate correct mutual positioning.

Figure 11:
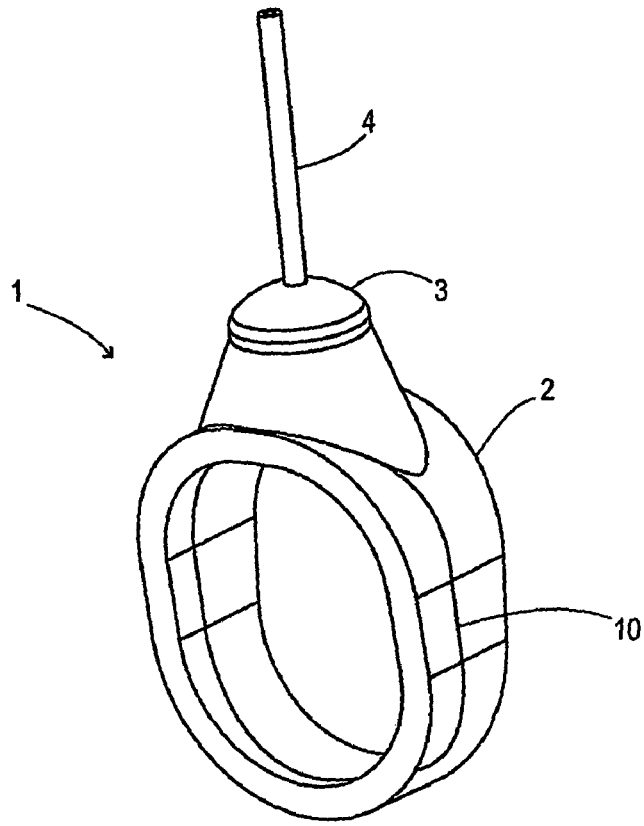
FIG. 11 is a perspective view of an adapter according to an embodiment of the adapter with additional positioning means for the sleeve.
Figure 12:
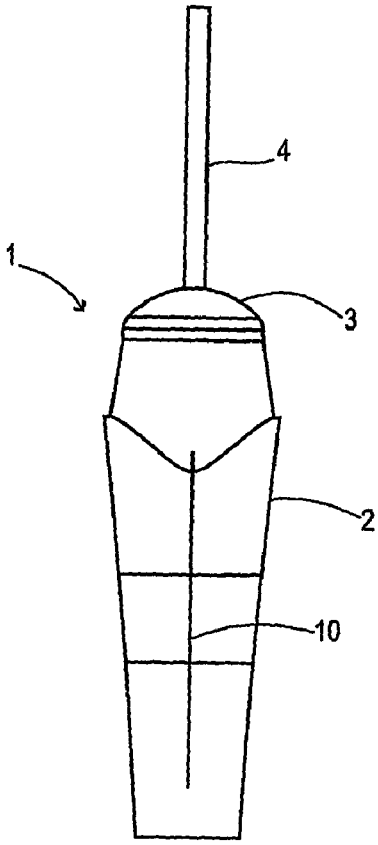
FIG. 12 is a side view of the adapter of FIG. 11.

Further position indicating means may be envisaged. As illustrated in FIGS. 11 and 12, the transparent sleeve 2 could be provided with a marker 10, e.g. in the form of a colored line running along the inner circumference of the sleeve. Also, the marker could be provided in the form of an inner circumferential groove. Both such a groove and such a colored line 10 would be readily visible from the outside through the transparent sleeve 2 so as to provide a positioning indicator.

The use of a groove provides the further advantage over a line that it may cooperate with appropriate protrusions (not shown) on the hearing aid housing 8. Such protrusions would, if present on a given hearing aid housing 8, engage the groove and aid in the correct positioning of the adapter. If the hearing aid is of a construction, which does not have such protrusions, the groove will simply serve as a positioning line.

On the free end of the metal tube 4, a probe tube 6 is fitted. The outer diameter of the metal tube 4 is slightly larger than the internal diameter of the probe tube 6. The probe tube 6 is made of an elastic, resilient material adapted to fit securely over the free end of the metal tube 4. Preferably the probe tube 6 is also adapted to fit inside the sound output port 11 of the hearing aid. The probe tube 6 may be interchangeable or be secured to the metal tube 4 so as to form an integral part of the adapter. A probe tube 6 typically has the following dimensions: External diameter 1.5 mm, internal diameter 0.6 mm and length 150 mm. With such dimensions the external diameter of the metal tube 4 would preferably be 0.63 to ensure the secure fit mentioned above.

Such dimensions of the probe tube 6 allow it to withstand the pressure between the ear canal and the earplug so that the internal lumen of the probe tube 6 is not blocked or throttled, when, during the real ear measurement, the probe tube 6 is placed along the earplug, e.g. as illustrated in U.S. Pat. No. 4,827,525. This document however does not relate to the measurements using the microphone 8*a* of the hearing aid itself, and is not considered relevant for the device of the present invention in general.

Evidently, the invention is not restricted to the use of the probe tube 6 in this manner, it is in principle immaterial for the adapter whether the probe tube 6 lies alongside the earplug or passes through it during the real ear measurements, e.g. as it is known from U.S. Pat. No. 5,645,074.

Figure 5:
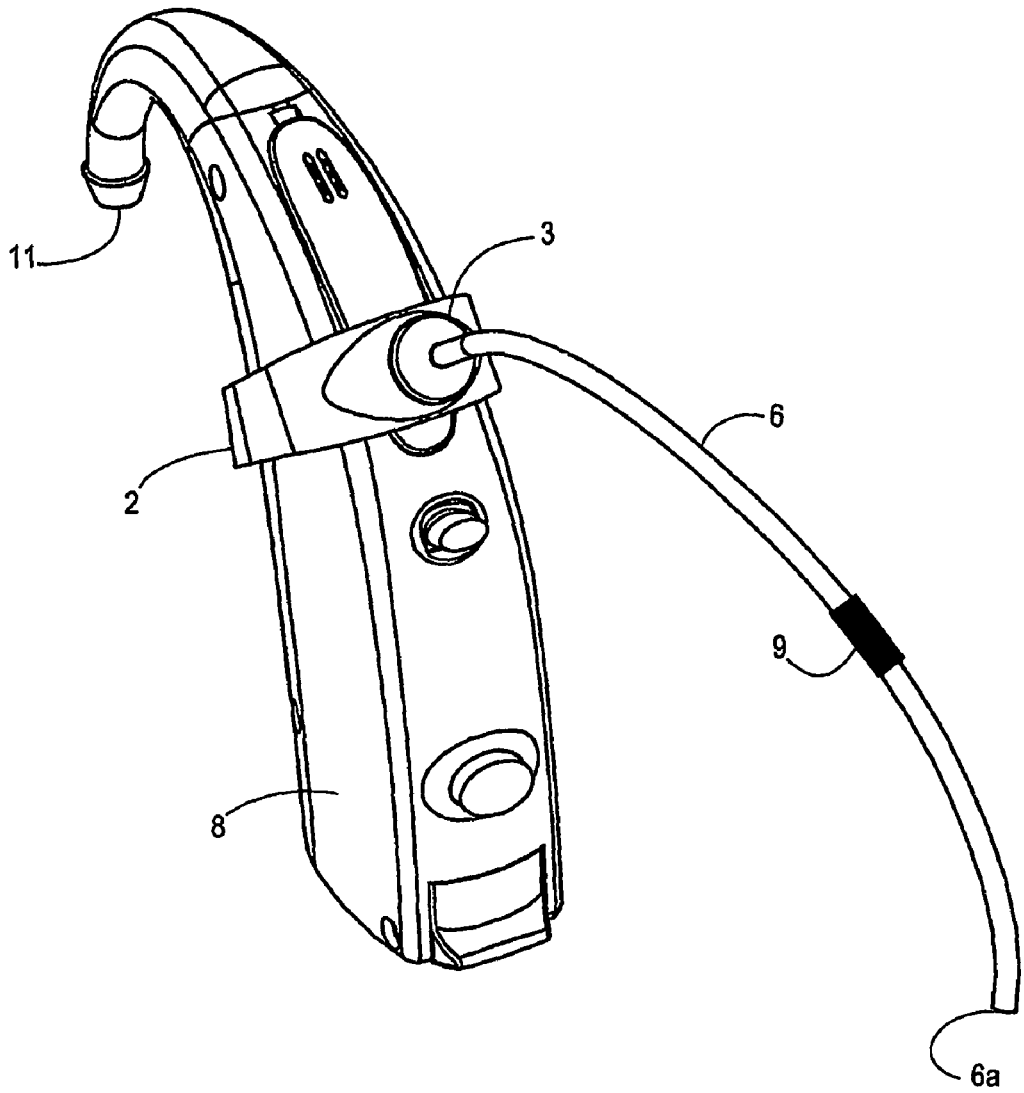
FIG. 5 is a perspective view of the adapter of FIG. 1 mounted on a first hearing aid.
Figure 7:
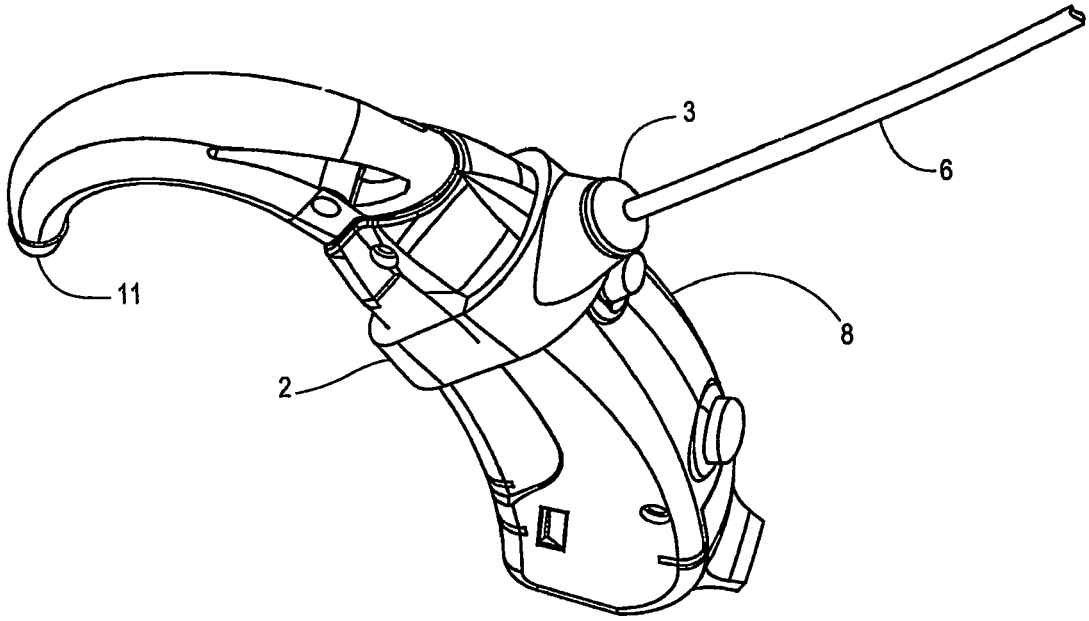
FIG. 7 is a perspective view of the adapter of FIG. 1 mounted on a second hearing aid different from the first hearing aid of FIG. 5.

Due to the elastic properties of the sleeve 2, the adapter is capable of adapting to a wide range of different hearing aids. This is illustrated in FIGS. 5 and 7, where the same adapter is used in conjunction with two different hearing aids with different housings 8. Thus, one and the same adapter may be used with various hearing aids, provided that a microphone port 7*a* is accessible at an appropriate place. In the example illustrated, the rear microphone 8*a* of directional hearing aids of the behind-the-ear type is used.

Figure 6:
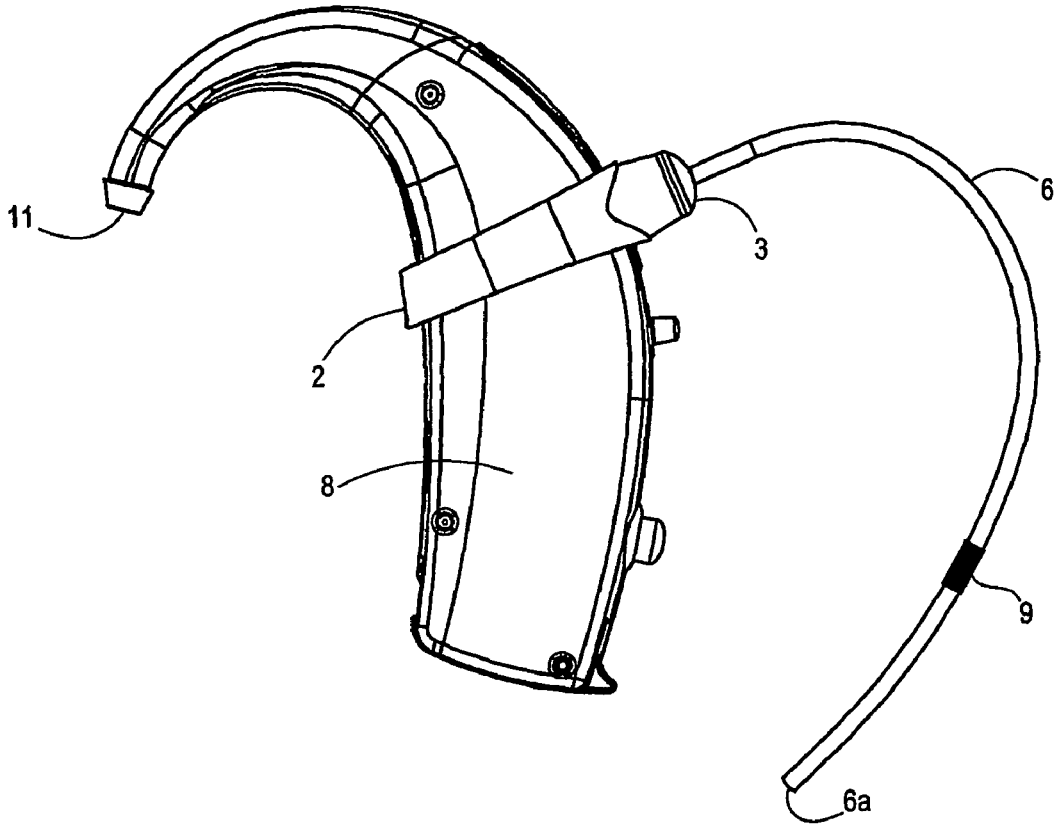
FIG. 6 is a side view corresponding to that of FIG. 5 with the adapter mounted on the first hearing aid.
Figure 8:
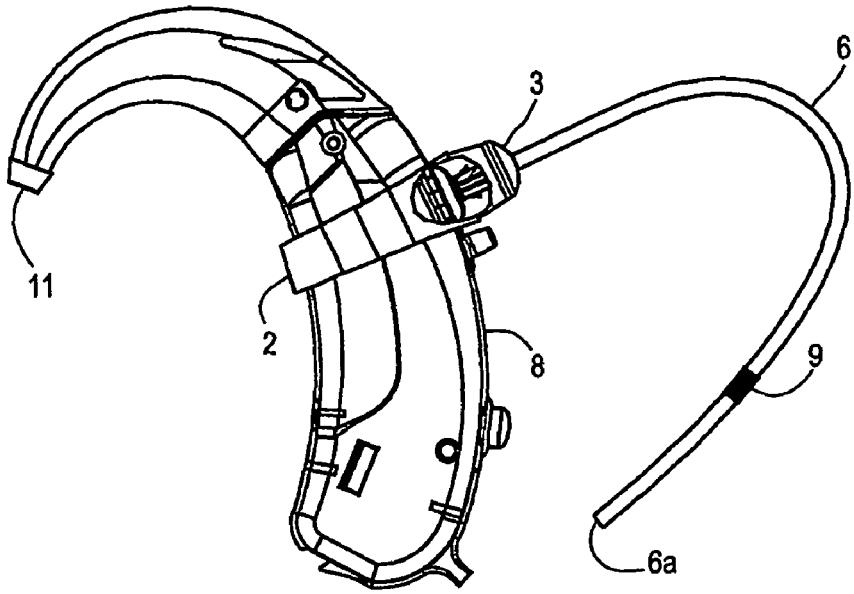
FIG. 8 is a partially cut away side view corresponding to that of FIG. 7 with the adapter mounted on the second hearing aid.
Figure 10:
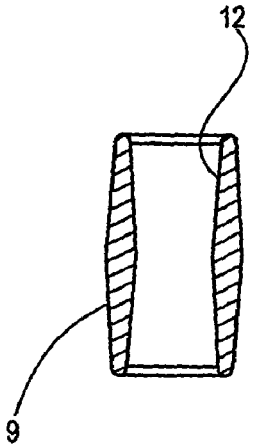
FIG. 10 is a cross sectional view of a positioning means on the probe tube for correct positioning thereof in an ear.

FIGS. 5, 6 and 8 illustrate placing a collar providing a positioning device 9 on the probe tube 6. The positioning device 9 itself is illustrated in cross section in FIG. 10. The positioning device is a generally cylindrical member with a central bore 12. The diameter of the central bore 12 is adapted to the probe tube 6 with which it is to be used, i.e. to the outer diameter thereof. The central bore 12 may be generally cylindrical or it may as illustrated comprise two frusto-conical parts, allowing the bore to taper slightly towards the middle section of the positioning device 9. The overall length is approximately 3 mm, allowing the positioning member to be digitally gripped and slid along the probe tube 6. It thereby allows better positioning than known positioning means, such as the rubber rings illustrated in U.S. Pat. No. 4,827,525, which during the positioning operation will be invisible under the fingers.

During the positioning operation, the positioning member 9 is slid along the probe tube 6 to a selected place, where it is held in place by friction. The fitter will select the place, measuring the length of fitting tube protruding from the collar 9 to the end 6*a* of the tube. When inserting the earplug into the users ear canal, the probe tube will be placed along the earplug with the collar 9 just outside the earplug. In this way the fitter will be able to verify that the probe tube free end 6*a* protrudes beyond the earplug by a suitable length.

For performing a real ear measurement, the adapter 1 will be slid over the hearing aid housing 8 to a proper position, where it will be retained by friction between the sleeve and the hearing aid housing.

Before using the hearing aid for real ear measurements with the adapter 1 fitted on the housing 8, be it in the form of a sleeve 2 fitted with an attached probe tube 6 or as an integral device, it may be calibrated. For this calibration, the free end 6*a* of the probe tube 6 is simply inserted into the sound output port 11 of the hearing aid.

The hearing aid may now be calibrated based on reference input signals to the hearing aid, or by reference signals generated by the hearing aid itself. Because of the direct coupling between the reference signals and the sound pressures measured, the hearing aid may then be calibrated to determine the transfer function through a signal path including the receiver, the probe tube and the microphone, i.e. the aggregate of the transfer functions of the respective component items. The sound pressure developed by the hearing aid when placed in a standard coupler is determined by a standard calibration procedure known in the art.

For the real ear measurements themselves, the hearing may be placed in its proper place behind the ear. The probe tube 6 is placed between the ear canal and the earplug, so that it lies along the earplug, and the free end 6*a* of the probe tube 6 is at an appropriate place in the cavity between the tympanic membrane and the earplug. Test signals are then delivered to or produced by the hearing aid, and the resultant sound pressure is measured in the cavity. The difference between the sound pressure measured in the cavity and the sound pressure developed by the hearing aid in a standard coupler signifies the desired value, which is traditionally designated the Real Ear to Coupler Difference, abbreviated RECD. How to perform and evaluate such measurements is known by the skilled person and will not be described any further here.

I claim:

1. An adapter for coupling a probe tube for real ear measurements to a microphone of a hearing aid, comprising a sleeve adapted to be arranged around the housing of a hearing aid, said sleeve comprising a sound opening allowing sound to pass from the probe tube to the microphone.

2. The adapter according to claim 1, wherein the sleeve comprises a tubular member arranged in connection with said sound opening and adapted for engaging the inner wall of said probe tube.

3. The adapter according to claim 2, wherein the tubular member is a metal tube.

4. The adapter according to claim 1, wherein the sleeve is made of a resilient material.

5. The adapter according to claim 1, wherein the sleeve is at least partially made of a transparent material.

6. The adapter according to claim 1, wherein the sleeve is made of silicone rubber.

7. The adapter according to claim 1, wherein the sleeve comprises a sleeve positioning means.

8. The adapter according to claim 1, wherein the sleeve comprises a visual sleeve positioning means.

9. The adapter according to claim 7, wherein the sleeve positioning means comprises a groove.

10. A device for real ear measurements, comprising a probe tube and an adapter for connecting the probe tube to a microphone of a hearing aid, said adapter having a sleeve adapted to be placed around the housing of the hearing aid, and said sleeve providing a sound opening allowing sound to pass from the probe tube to the microphone.

11. The device according to claim 10, wherein the sleeve and the probe tube constitute an integral unit.

12. The device according to claim 10, wherein the probe tube comprises tube positioning means for verification of the positioning in the ear.

13. The device according to claim 12, wherein the tube positioning means comprises a sleeve slidable along the probe tube.

14. A method for performing real ear measurements using a microphone of a hearing aid, comprising the steps of providing a probe tube;

providing an adapter for connecting the probe tube to the microphone, said adapter having a sleeve adapted to be placed around the housing of the hearing aid, and said sleeve providing a sound opening allowing sound to pass from the probe tube to the microphone;

fitting said adapter around the housing of the hearing aid so that the sound opening is placed over the microphone;

placing the probe tube in the ear in such a way that a free end thereof presents an opening in the cavity between the earplug and the tympanic membrane; and detecting the sound pressure from sounds produced by said hearing aid in said cavity using said microphone.

15. The method according to claim 14, comprising a calibration step, in which the free end of the probe tube is placed in close conjunction with an output transducer of the hearing aid, and in which the sound pressure is measured based on predetermined signals from the hearing aid.

16. The method according to claim 15, wherein said calibration step precedes said step of detecting the sound pressure.

* * * * *